US006176333B1

(12) United States Patent
Doster

(10) Patent No.: US 6,176,333 B1
(45) Date of Patent: Jan. 23, 2001

(54) DIAMOND CAP CUTTING ELEMENTS WITH FLATS

(75) Inventor: Michael L. Doster, Spring, TX (US)

(73) Assignee: Baker Huges Incorporated, Houston, TX (US)

( * ) Notice: Under 35 U.S.C. 154(b), the term of this patent shall be extended for 0 days.

(21) Appl. No.: 09/205,968

(22) Filed: Dec. 4, 1998

(51) Int. Cl.[7] ..... E21B 10/46
(52) U.S. Cl. ..... 175/428; 175/434
(58) Field of Search ..... 175/331, 334, 175/428, 430, 426, 434

(56) References Cited

U.S. PATENT DOCUMENTS

| | | | | |
|---|---|---|---|---|
| 3,388,757 | | 6/1968 | Fittinger | 175/410 |
| 3,442,342 | * | 5/1969 | McElya et al. | 175/374 |
| 4,058,177 | | 11/1977 | Langford, Jr. et al. | 175/374 |
| 4,109,737 | | 8/1978 | Bovenkerk | 175/329 |
| 4,334,586 | | 6/1982 | Schumacher | 175/374 |
| 4,343,371 | | 8/1982 | Baker, III et al. | 175/329 |
| 4,716,977 | | 1/1988 | Huffstutler | 175/410 |
| 5,172,779 | * | 12/1992 | Siracki et al. | 175/420.1 |
| 5,348,108 | | 9/1994 | Scott et al. | 175/432 |
| 5,467,836 | * | 11/1995 | Grimes et al. | 175/401 |
| 5,592,995 | * | 1/1997 | Scott et al. | 175/374 |
| 5,630,479 | * | 5/1997 | Dennis | 175/426 |
| 5,655,612 | | 8/1997 | Grimes et al. | 175/401 |
| 5,752,573 | | 5/1998 | Scott et al. | 175/374 |
| 5,758,733 | | 6/1998 | Scott et al. | 175/432 |
| 5,890,552 | * | 4/1999 | Scott et al. | 175/426 |

FOREIGN PATENT DOCUMENTS

| | | |
|---|---|---|
| 2031047 | 4/1980 | (DE) . |
| 0802301 A2 | 10/1997 | (EP) . |

* cited by examiner

*Primary Examiner*—Lanna Mai
*Assistant Examiner*—Elaine Gort
(74) *Attorney, Agent, or Firm*—Felsman, Bradley, Vaden, Gunter & Dillon, L.L.P.; James E. Bradley

(57) ABSTRACT

An earth-boring drill bit of the rolling cutter type has cutting elements press fitted into mating holes in the cutter. Each of the cutting elements has a tungsten carbide cylindrical base and a cutting end protruding from the base. A diamond cap is bonded to the cutting end. A plurality of flats are formed in the conical sidewall surrounding the apex. The flats are identical to each other and have oval perimeters. Portions of the perimeters are contiguous with adjacent flats to create sharp edges.

11 Claims, 2 Drawing Sheets

DIAMOND CAP CUTTING ELEMENTS WITH FLATS

TECHNICAL FIELD

This invention relates in general to earth-boring bits and particular to an earth-boring bit having tungsten carbide cutting elements with diamond caps.

BACKGROUND ART

The success of rotary drilling enabled the discovery of deep oil and gas reservoirs. The rotary rock bit was an important invention that made rotary drilling economical.

In drilling boreholes in earthen formations by the rotary method, rock bits typically fitted with three rolling cutters are employed. The bit is secured to the lower end of a drill string that is rotated from the surface or by downhole motors or turbines. The cutters mounted on the bit roll and slide upon the bottom of the borehole as the drill string is rotated, thereby engaging and disintegrating the formation material to be removed. The roller cutters are provided with teeth or cutting elements that are forced to penetrate and gouge the bottom of the borehole by weight from the drill string. The cuttings from the bottom and sidewalls of the borehole are washed away by drilling fluid that is pumped down from the surface through the hollow, rotating drill string and are carried in suspension in the drilling fluid to the surface.

It has been a conventional practice for several years to provide diamond or super-hard cutting elements or inserts in earth-boring bits known as PDC, or fixed cutter bits. The excellent hardness, wear, and heat dissipation characteristics of diamond and other super-hard materials are of particular benefit in fixed cutter or drag bits, in which the primary cutting mechanism is scraping. Diamond cutting elements in fixed cutter or drag bits commonly comprise a disk or table of natural or polycrystalline diamond integrally formed on a cemented tungsten carbide or similar hard metal substrate in the form of a stud or cylindrical body that is subsequently brazed or mechanically fit on a bit body.

Implementation of diamond cutting elements as the primary cutting structure in earth-boring bits of the rolling cutter variety has been somewhat less common than with earth boring bits of the fixed cutter variety. In the rolling cutter variety, generally a diamond cap is formed on a cylindrical tungsten carbide base. The cap may be conical, hemispherical, or other shapes. While successful, improvements in wear resistance and penetration rate are desired.

DISCLOSURE OF INVENTION

In this invention, the cutting elements have cylindrical bases of tungsten carbide. Each cutting element has a diamond cap extending upward from a junction with the base, terminating in a rounded apex. Flats are formed in the sidewall of the cap surrounding the apex. Each flat is located in a single plane and has a perimeter which is oval in shape. A portion of each perimeter is contiguous with adjacent flats, creating sharp edges.

BEST MODE FOR CARRYING OUT THE INVENTION

Figure 1:
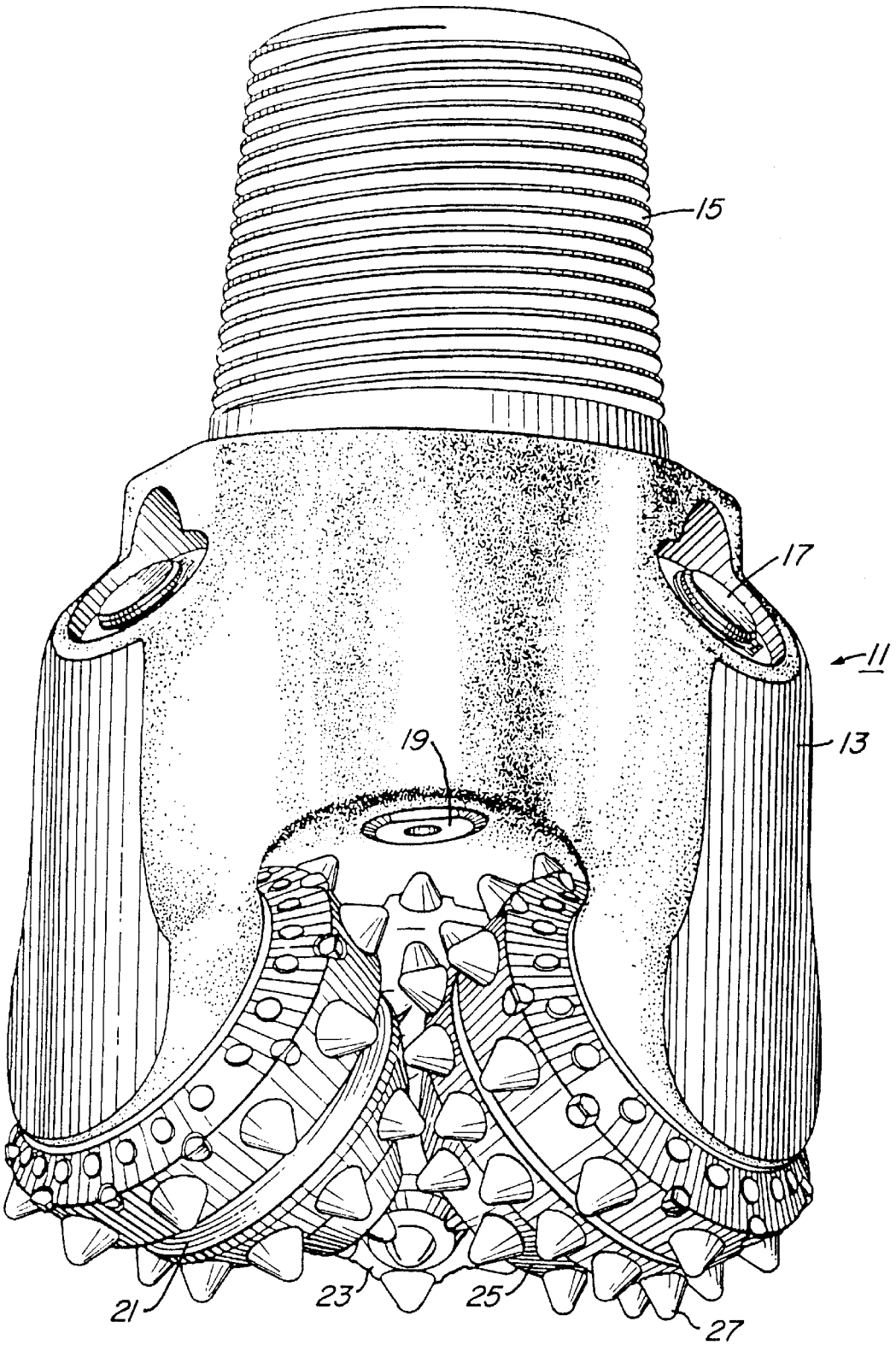
Fig. 1 (PRIOR ART)
FIG. 1 is a side elevational view of an earth boring bit having cutting elements of a prior art type.

Referring to FIG. 1, earth boring bit 11 includes a bit body 13 which is threaded at its upper extent 15 for connection into a drill string. Each leg or section of bit 11 is provided with a lubricant compensator 17. At least one nozzle 19 is provided in bit body 13 to spray drilling fluid from within the drill string to cool and lubricate bit 11 during drilling operation. Three conical cutters 21, 23, 25 are rotatably secured to bearing shafts associated with each leg of bit body 13.

Each cutter 21, 23, 25 has a cutter shell surface which provides a cutter element support for cutting elements 27. Cutting elements 27 are arranged in generally circumferential rows on the cutter shell surface. Cutting elements 27 may have a variety of shapes, including hemispherical or the conical configuration shown in the figures. Earth boring bit 11 as shown in FIG. 1 is conventional.

Figure 2:
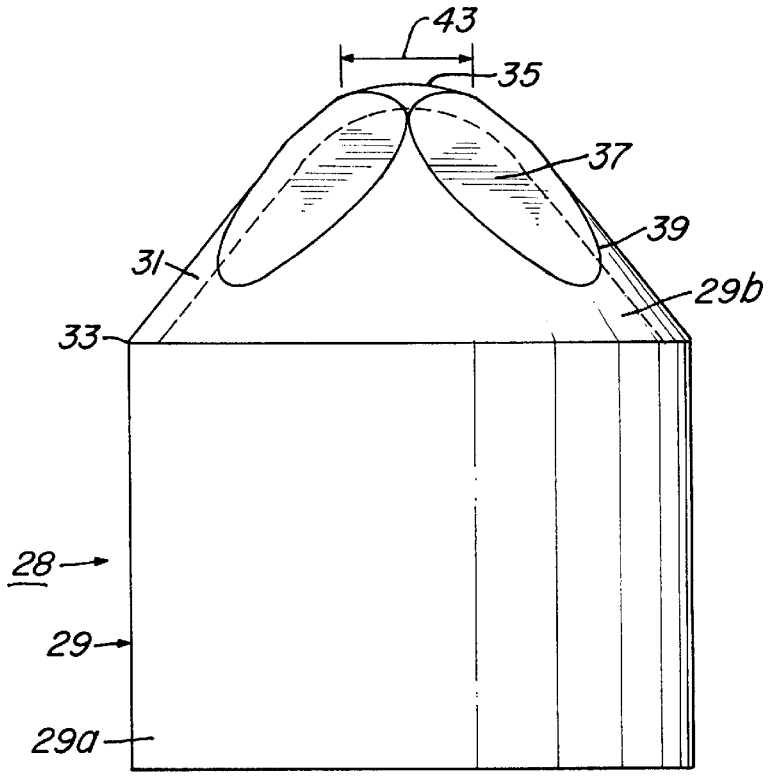
FIG. 2 is a side elevational view of a cutting element constructed in accordance with this invention for the earth boring bit of FIG. 1.

Referring to FIG. 2 in this invention, a plurality of cutting elements 28 (only one shown) are formed for installation on cutters 21, 23, 25 in the same manner and position as the cutting elements 27 of the prior art. Each cutting element 28 has a body 29 of tungsten carbide. In the embodiment shown, body 29 has a cylindrical base **29*a* which is press-fitted into a mating hole in one of the cutters 21, 23, 25. Body 29 has a convex cutting end 29*b* that protrudes upward from base 29*a* as indicated by dotted lines. Cutting end 29*b* will protrude from the hole in one of the cutters 21, 23, 25. A cap 31 extends upward from base 27, covering cutting end 29*b*. The words "upper" and "lower" are used for convenience only, as in use cutting end 29*b* will not always be oriented above base 29*a*. Cap 31** is conical in the embodiment shown, but may be other shapes such as hemispherical.

Cap 31 is a layer of diamond which has been bonded under high pressure and temperature to the underlying tungsten carbide cutting end **29*b*. A procedure for applying diamond cap 31 to the underlying tungsten carbide cutting end 29*b* is described in U.S. Pat. No. 5,758,733, Jun. 2, 198, Scott et al. Cap 31 has a junction 33 with base 29*a*. The sidewalls of cap 31 terminate in a rounded apex 35 on the upper end of cap 31. Apex 35** is arcuate in cross-section.

Figure 3:
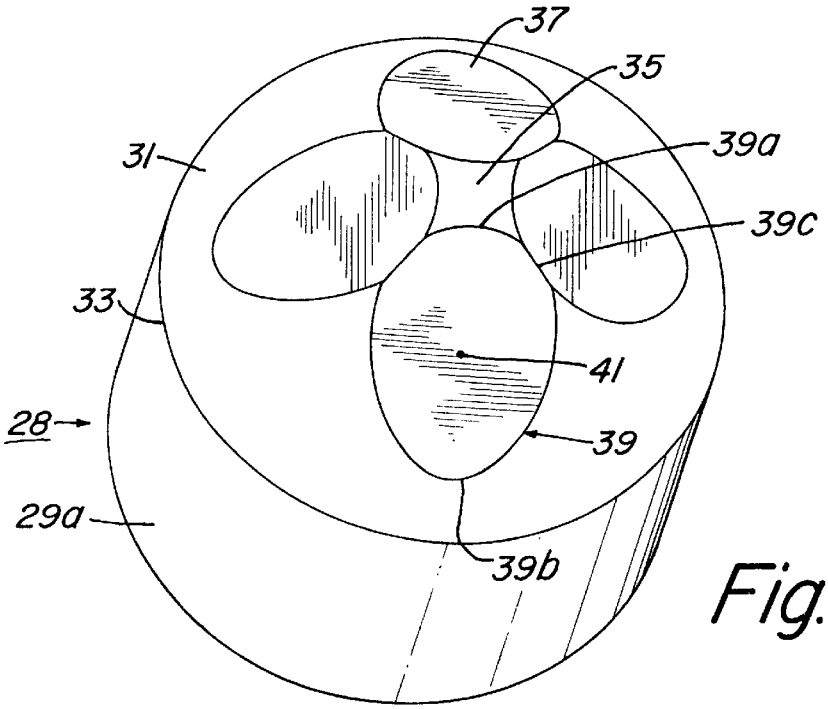
FIG. 3 is a perspective view of the cutting element of FIG. 2.

A plurality of flats 37 are ground in cap 31 after it has been joined to body 29. Flats 37 are formed around apex 35 and are preferably identical to each other. As shown also in FIG. 3, each flat 37 is located in a single plane and has an oval shaped perimeter 39. Perimeter 39 has an upper extremity **39*a* which extends into a lower portion of apex 35. Perimeter 39 has a lower extremity 39*b* which terminates above junction 33. Perimeter 39 also has two opposite contiguous side portions 39*c* which join adjacent flats 37 on each side. The junction of contiguous side portions 39*c* results in a sharp edge. Because of the oval shape of perimeter 39, only a portion of perimeter 39 on each side is contiguous with adjacent flats 37**.

Each flat 37 has a midpoint 41. The length of each flat 37 from upper extremity **39*a* to lower extremity 39*b* when measured through midpoint 41, is greater than its width at any point. The maximum width in the upper portion of each flat 37 above midpoint 41 is greater than the width in the lower portion below midpoint 41**. The upper portion and the lower portion are elliptical.

In the embodiment shown, there are four flats 37, each being identical to the other. A different number than four could also be used. The portion of apex 35 extending above flats 37 is generally in the shape of a diamond. The maximum width 43 of this portion of apex 35 is less than one-fourth (¼) the diameter of base **29*a*** in the embodiment shown.

During manufacturing, cutting elements 28 are constructed conventionally by bonding diamond cap 31 to body 29. Then cutting elements 28 are ground to size. The grinding also includes grinding flats 37. Cutting elements 28 will then be press fitted into mating holes in the cutters 21, 23, 25.

During operation, drill bit 11 is used conventionally. As bit 11 is rotated, cutters 21, 23, 25 roll about the borehole bottom. Cutting elements 28 contact the borehole bottom, causing the formation to fail and disintegrate.

The invention has significant advantages. The grinding process to form the flats help wear resistance by removing imperfections in the cap. The cap becomes sharper by the grinding of the flats, increasing the contact pressure with the formation. This aids in the disintegration of the formation, especially if it is a harder or more brittle type of formation.

While the invention has been shown in only one of its forms, it should be apparent to those skilled in the art that it is not so limited, but is susceptible to various changes without departing from the scope of the invention.

I claim:

1. A cutting element for an earth boring drill bit, comprising:

a body of tungsten carbide having a cylindrical base adapted to be inserted into a mating hole in a drill bit;

a diamond cap secured to the body, the cap having a sidewall which terminates in a rounded apex;

at least three substantially identical flats symmetrically formed in the sidewall around the apex, each of the flats being located in a single plane;

wherein the perimeter of each of the flats has a side portion which is contiguous with a portion of the perimeter of an adjacent one of the flats; and the flats being spaced from a junction of the cylindrical base and the cutting end; and wherein each of the flats has an oval perimeter.

2. The cutting element of claim 1, wherein each of the flats has a length measured from a lower extremity to an upper extremity, each of the flats having contiguous side portions with adjacent ones of the flats, and wherein the contiguous side portions are located only above a mid-point of the length.

3. A cutting element for an earth boring drill bit, comprising:

a body of tungsten carbide having a cylindrical base adapted to be inserted into a mating hole in a drill bit;

a cutting end formed on the body and joining the cylindrical base, the cutting end having a diamond cap secured thereto, the cap having a sidewall which terminates in a rounded apex;

at least four substantially identical flats formed in a symmetrical array in the sidewall around the apex, each of the flats having a perimeter with a side portion which is contiguous with a portion of the perimeter of an adjacent one of the flats, the flats being spaced from a junction of the cylindrical base and the cutting end and wherein each of the flats has an oval perimeter.

4. The cutting element of claim 3, wherein the cap is conical.

5. The cutting element of claim 3, wherein each of the flats has a greater maximum width measured perpendicular to the length, above a mid-point than below.

6. The cutting element of claim 3, wherein each of the flats has a length measured from a lower extremity to an upper extremity, and wherein the contiguous side portions are located only above a mid-point of the length.

7. An earth boring drill bit, comprising:

a bit body having at least one bit leg;

a cutter rotatably mounted to the bit leg;

a plurality of cutting elements mounted to the cutter for disintegrating an earth formation;

each of the cutting elements having a cylindrical base of tungsten carbide adapted to be inserted into a mating hole in the cutter and a cutting end protruding from and forming a junction with the base;

the cutting end having a diamond cap secured thereto, the cap having a sidewall which extends upward to an apex which is arcuate in cross-section;

at least four substantially identical flats formed in a symmetrical array in the sidewall around the apex, each of the flats being located in a single plane and having a generally oval perimeter, the oval perimeters having contiguous side portions with the flats located on each side, the perimeter of each of the flats having an upper extremity spaced below the apex and a lower extremity spaced above the junction of the cylindrical base and the cutting end and wherein each of the flats has an oval perimeter.

8. The cutting element of claim 7, wherein each of the flats has a length measured from the upper extremity to the lower extremity, and wherein the contiguous side portions are located above a midpoint of the length.

9. The cutting element of claim 7, wherein each of the flats has a greater maximum width, measured perpendicular to the length, above the midpoint than below.

10. The cutting element of claim 7, wherein a portion of the apex above the flats has a maximum width, measured perpendicular to an axis of the base, which is less than one-fourth a diameter of the base.

11. The cutting element of claim 7, wherein the cap is conical.

* * * * *